US005320170A

United States Patent [19]

Huang et al.

[11] Patent Number: 5,320,170

[45] Date of Patent: Jun. 14, 1994

[54] OIL RECOVERY PROCESS EMPLOYING HORIZONTAL AND VERTICAL WELLS IN A MODIFIED INVERTED 5-SPOT PATTERN

[75] Inventors: Wann-Sheng Huang, Houston; Jack J. Hsu, Meadows; Ben N. Wang, Sugar Lane, all of Tex.

[73] Assignee: Texaco Inc., White Plains, N.Y.

[21] Appl. No.: 921,675

[22] Filed: Jul. 30, 1992

[51] Int. Cl.[5] ..... E21B 43/24; E21B 43/30

[52] U.S. Cl. ..... 166/245; 166/50; 166/263

[58] Field of Search ..... 166/50, 245, 263, 268

[56] References Cited

U.S. PATENT DOCUMENTS

| | | | |
|---|---|---|---|
| 3,402,768 | 9/1968 | Felsenthal et al. | 166/263 X |
| 4,637,461 | 1/1987 | Hight | 166/245 |
| 4,646,824 | 3/1987 | Huang et al. | 166/52 |
| 4,662,441 | 5/1987 | Huang et al. | 166/263 X |
| 4,682,652 | 7/1987 | Huang et al. | 166/263 |
| 4,702,314 | 10/1987 | Huang et al. | 166/245 |
| 4,718,485 | 1/1988 | Brown et al. | 166/50 |
| 4,727,937 | 1/1988 | Shum et al. | 166/245 |
| 5,065,821 | 11/1991 | Huang et al. | 166/263 X |

*Primary Examiner*—George A. Suchfield

*Attorney, Agent, or Firm*—James L. Bailey; Kenneth R. Priem; Harold J. Delhommer

[57] ABSTRACT

A method of recovering hydrocarbons from underground formations by employing a modified inverted 5-spot well pattern, which comprises drilling four substantially horizontal wells located along each of the four sides of an inverted 5-spot vertical well pattern, injecting an oil recovery fluid through the central injection well, producing hydrocarbons and other fluids through the vertical corner production wells, ceasing production through the vertical corner wells, and producing hydrocarbons and other fluids through the horizontal wells.

6 Claims, 2 Drawing Sheets

OIL RECOVERY PROCESS EMPLOYING HORIZONTAL AND VERTICAL WELLS IN A MODIFIED INVERTED 5-SPOT PATTERN

BACKGROUND OF THE INVENTION

The invention process is concerned with the enhanced recovery of oil from underground formations. More particularly, the invention relates to a sequenced process for recovering hydrocarbons employing modified inverted 5-spot patterns containing horizontal and vertical wells.

Horizontal wells have been investigated and tested for oil recovery for quite some time. They have been proved economically successful to recover petroleum from many types of formation such as formations with highly viscous crude, thin pay zones, and difficult injectivity. It seems likely that horizontal wells will soon become more widely used in a variety of formations, especially for highly viscous oils and sands which cannot be efficiently or economically produced by conventional methods.

Various proposals have been set forth for petroleum recovery with horizontal well schemes. Most have involved steam injection or in situ combustion with horizontal wells serving as both injection wells and producing wells. Steam and combustion processes have been employed to heat viscous formations to lower the viscosity of the petroleum as well as to provide the driving force to push the hydrocarbons toward a well.

U.S. Pat. No. 4,637,461 discloses the use of inverted 9-spot and inverted 13-spot patterns having horizontal wells located along the borders of the well patterns between vertical wells. U.S. Pat. No. 4,646,824 shows numerous variations of modified inverted 5-spot well patterns having horizontal wells located along the borders between vertical wells. However, every well pattern disclosed in this patent teaches that all five vertical wells are injection wells.

Variations on inverted 5-spot and 9-spot well patterns with and without vertical corner wells are disclosed in U.S. Pat. No. 4,702,314. All horizontal wells in this reference are radial and located between the central injection well and corner production wells.

Additional variations on modified inverted 5-spot, 9-spot, and 13-spot well patterns are disclosed in U.S. Pat. No. 4,718,485, wherein all horizontal wells are placed on the borders of the well patterns. Some of the well patterns disclosed have additional interior injection wells. U.S. Pat. No. 4,727,937 discloses similar variations on modified inverted 13-spot patterns having horizontal wells located on the borders of the pattern; some patterns without vertical side wells and some patterns without vertical corner wells.

SUMMARY OF THE INVENTION

The invention is a method of recovering hydrocarbons from underground formations by employing a modified inverted 5-spot well pattern, which comprises a multi-step method of producing vertical and horizontal wells in sequence. If the horizontal wells do not exist in the pattern, then four substantially horizontal wells must be drilled, each horizontal well located approximately along each of the four sides of a substantially rectangular inverted 5-spot vertical well pattern, said inverted 5-spot pattern containing a substantially vertical central injection well and four substantially vertical corner production wells. An oil recovery fluid is injected into the formation through the central injection well, and hydrocarbons and other fluids are produced through the vertical corner production wells. Then, production is ceased through the vertical corner wells, and hydrocarbons and other fluids are produced through the horizontal wells.

Preferably, production is ceased through the vertical corner wells about the time of recovery fluid breakthrough at the vertical corner wells. Switching production to the horizontal wells at this time aids in preventing undue channelization and gravity override zones by sweeping different areas of the formation within the boundaries of the modified inverted 5-spot well pattern.

DETAILED DESCRIPTION

Figure 1:
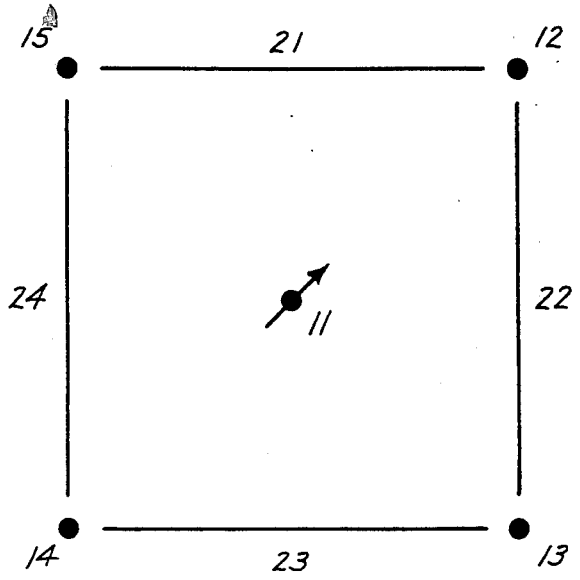
FIG. 1 illustrates the modified inverted 5-spot well pattern used in the invention process.

Although enhanced oil recovery floods by central well injection in inverted 5-spot and inverted 9-spot well patterns have attained oil recoveries in excess of 50%, these well patterns can leave areas of high oil saturation in the lower layers of oil sands. High residual oil saturations are left in thick oil sands. The additional production of infill wells between central injectors and corner wells are effective in improving conformance, but still fail to reduce oil saturation in the lower portions of the pay zone between the corner wells and between the corner and side wells.

Horizontal wells drilled between corner wells of rectangular well patterns can improve vertical conformance of floods and increase oil recovery to a large degree. The inclusion of these horizontal wells may allow the use of larger pattern sizes. Such horizontal and vertical well combination patterns are also particularly applicable to thick reservoirs where gravity override is a major drawback to enhanced oil recovery operations.

Most prior art and field tests have involved the use of steam or some hot recovery fluid. The prior art generally ignores immiscible or miscible gas flooding with patterns involving the combination of horizontal and vertical wells.

The invention requires the use of a modified inverted 5-spot well pattern having four substantially horizontal production wells, each horizontal well located approximately on each of the four sides of a substantially rectangular, inverted 5-spot well pattern. The inverted 5-spot pattern contains a substantially vertical and central injection well and four substantially vertical corner production wells.

In the beginning of the invention process, an oil recovery fluid is injected into the formation through the central injection well. Hydrocarbons and other fluids are produced through the vertical corner production wells. After a period of time, preferably about the time of recovery fluid breakthrough at the vertical corner wells, production through the vertical corner wells is ceased, and hydrocarbons and other fluids are produced through the horizontal production wells. Cyclic injection and production of an oil recovery fluid may be done at the horizontal wells prior to ceasing production at the vertical corner wells.

The oil recovery fluid in the invention method may be steam, carbon dioxide, nitrogen, methane, ethane, surfactant systems, microemulsions, a mixture of non-condensable gases, or mixtures thereof. Preferably, the oil recovery fluid is carbon dioxide, nitrogen, methane, steam, or a mixture of non-condensable gases. Although the invention method is particularly appropriate with a gaseous oil recovery fluid, the invention method will also work effectively with predominately liquid oil recovery fluids such as surfactant systems, as well as a mixed liquid/gas recovery fluid such as steam.

The invention requires the use of the five vertical wells normally employed in an inverted 5-spot well pattern and the four horizontal production wells located along the borders of the well pattern between the vertical corner wells. If the vertical wells already exist in the form of an inverted 5-spot well pattern, it is only necessary to drill and complete the four horizontal wells to practice the invention method. Depending upon the number and location of the existing vertical wells and the reservoir, it may also be necessary to drill and complete one or more vertical wells. If there are no existing wells in the reservoir area, then it would be necessary to drill and complete all five vertical wells and the four horizontal production wells. These variations are certainly within the scope of the present invention.

Water, preferably hot water or a viscous polymer solution, may be injected in an additional embodiment after the oil recovery fluid. Water usually is less costly then other oil recovery fluids and helps to maintain a positive pressure gradient to prevent oil re-saturation in the previously flooded, oil depleted zone of the reservoir. Water injection will also serve to scavenge some of the heat remaining in the depleted zone and carry that heat to the higher oil saturation areas. Produced water can be used as a source of injection water.

FIG. 1 illustrates the well pattern used to practice the invention process. Horizontal wells 21, 22, 23 and 24 are placed along the sides of a substantially rectangular well pattern having central injection well 11 approximately at the center of the pattern. Substantially vertical corner production wells 12,13,14 and 15 are shown at the corners of the rectangular well pattern.

The diameter and length of the horizontal wells and the perforation intervals are not critical, except that such factors will affect the well spacing and economics of the process. Such decisions should be determined by conventional drilling criteria, the characteristics of the specific formation, the economics of a given situation, and well known art of drilling horizontal wells. The distance of horizontal wells from other vertical wells is a balance of economic criteria. Perforation size will be a function of other factors such as flow rate, temperatures and pressures employed in a given operation.

Preferably, the horizontal wells will be extended into the formation at a position near the bottom of the formation. A relatively lower position in the formation will reduce the volume of any override zones of high oil saturation left by a gaseous recovery fluid. Preferably, the horizontal production wells are perforated over about the middle 30% to middle 60% of the distance between the vertical corner wells.

Such horizontal wells must run a substantially horizontal distance within the hydrocarbon formation. To communicate with the surface, horizontal wells may extend from the surface or may extend from a substantially vertical well within the formation, which communicates with the surface. Newly developed horizontal well technology has made it possible to drill substantially horizontal wells from an existing vertical wellbore. The horizontal wells may even run parallel to and within a pay zone having a certain degree of dip. Such wells are still considered horizontal wells for the purposes of this invention.

The following examples will illustrate the invention. They are given by way of illustration and not as limitations on the scope of the invention. Thus, it should be understood that a process can be varied from the description and the examples and still remain within the scope of the invention.

EXAMPLES

A commercially available 3-dimensional numerical simulator developed for enhanced oil recovery was employed for the examples. The simulation model used was COMP4 by Scientific Software-Intercomp. A total of 60 active grid blocks ($5\times3\times4$) were used in the simulation.

The simulations were set up to represent a typical West Texas Permian Basin carbon dioxide flood done in a water alternating gas (WAG) scheme. In the field, this would typically involve the injection of alternating slugs of carbon dioxide and water until the cumulative injection total was reached, followed by the continuous injection of water until a second total of injected pore volume was reached. To save computer simulation time, the simulations were set up for the simultaneous injection of carbon dioxide and water in equal proportions. Our research indicates that such simulations give data similar to that of a WAG flood with alternating slugs.

Reservoir thickness and porosity were set at 120 feet and 10%, respectively. Permeabilities in all directions were 20 millidarcies. Reservoir temperature was 110° F., and average reservoir pressure was 1500–1700 psi. Injection pressure was 2200 psi and production pressure was 1000 psi. A West Texas crude was modeled having an approximate API gravity of 35 degrees.

For all simulations, modelling began with the injection of about 0.77 pore volumes of water which produced a waterflood residual oil saturation of about 40%, followed by the simultaneous injection of equal amounts of carbon dioxide and water until 0.4 pore volumes of carbon dioxide and 0.4 pore volumes of water had been injected. The last step was the injection of about 0.9 pore volumes of water, which gave a cumulative injection of about 1.7 pore volumes of fluid after the simulated waterflood.

EXAMPLE 1 (FIG. 2)

Figure 2:
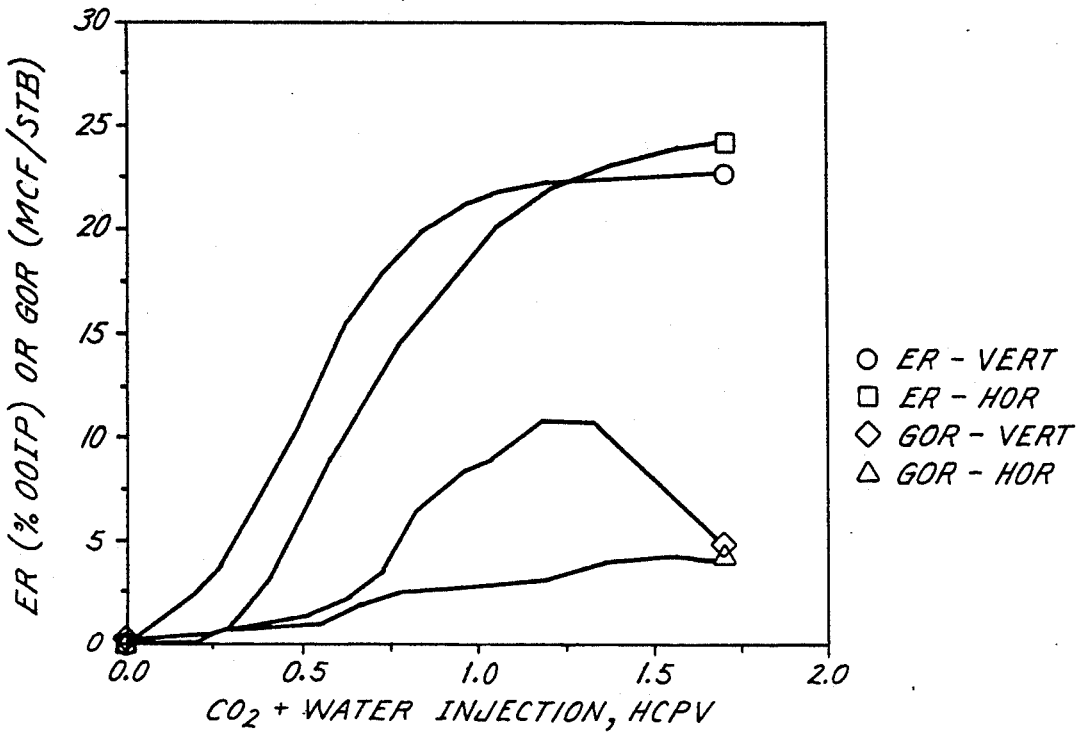
FIG. 2 graphs the oil recovery efficiency and gas-oil ratios of a miscible carbon dioxide flood in a modified inverted 5-spot well pattern that is disclosed in FIG. 2 of U.S. Pat. No. 4,702,314.

Example 1, with simulation results shown in FIG. 2, compares the results of the carbon dioxide flood for the well configuration disclosed in FIG. 2 of U.S. Pat. No. 4,702,314 with the simulation results achieved in the carbon dioxide flood in the inverted 5-spot vertical well pattern. The modified horizontal/vertical well pattern of this example is an inverted 5-spot vertical well pattern having a central injector and four corner production wells, along with four horizontal production wells, each running radially between the central injection well and the four corner production wells.

FIG. 2 indicates that the alternate oil recovery from the horizontal/vertical well configuration was slightly higher than that from the inverted 5-spot vertical well pattern alone (24% vs. 22.5% original oil in place (OOIP)). The smaller gas/oil ratio (GOR) indicates that less gas has to be handled in this case, an advantageous result.

EXAMPLE 2 (FIG. 3)

A comparison of a different horizontal/vertical well pattern (FIG. 2 of U.S. Pat. No. 4,718,485, wherein all horizontal wells are placed on the borders of the well pattern) was performed in Example 2 with the base case of the inverted 5-spot vertical well pattern. Recovery from the horizontal well pattern of FIG. 1 (the same pattern as FIG. 2 of U.S. Pat. No. 4,718,485) was simulated without the multi-step process of the present invention.

Figure 3:
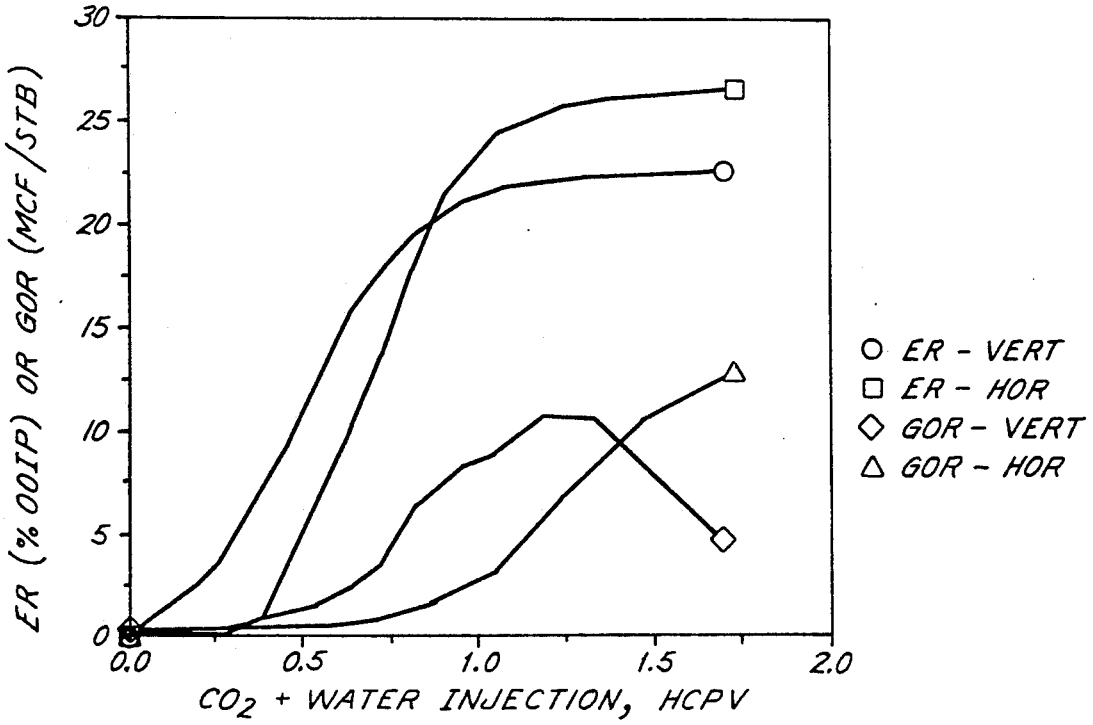
FIG. 3 graphs the oil recovery efficiency and gas-oil ratios of a miscible carbon dioxide flood in a modified inverted 5-spot pattern disclosed in FIG. 2 of U.S. Pat. No. 4,718,485.

The simulation results indicated that a higher recovery can be obtained by placing the horizontal wells along the pattern boundaries (26.5% OOIP vs. 22.5% OOIP). The recovery was higher than that for the radial horizontal well configuration of Example 1. However, the FIG. 3 graph illustrates a significant disadvantage of slow initial production, wherein almost zero production is achieved until after the injection of about 0.3 pore volumes of carbon dioxide and water. Such a slow initial production response has a significant effect on the economics of an enhanced oil recovery operation.

EXAMPLE 3 (FIG. 4)

Figure 4:
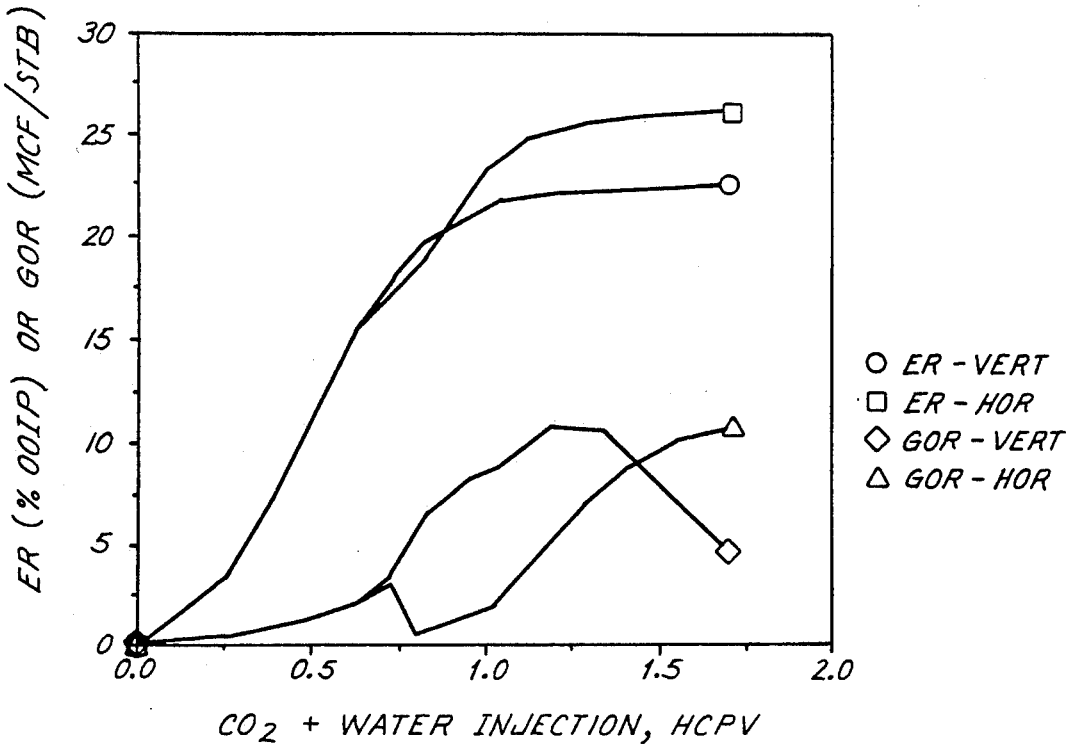
FIG. 4 graphs the oil recovery efficiency and gas-oil ratios of a miscible carbon dioxide flood in the modified inverted 5-spot well pattern of FIG. 1 according to the method of the instant invention.

Example 3 was simulated to compare the oil recovery obtained from a miscible carbon dioxide WAG flood performed according to the invention process with the previously simulated cases. In FIG. 4, the corner vertical wells were produced first. Production was ceased from the vertical corner wells and switched to the horizontal wells at a later time when the gas/oil ratio started to increase as shown in FIG. 4.

Overall recovery for the invention process was the same 26.5% OOIP of the horizontal well case of Example 2, but initial production response was substantially greater. In fact, initial production was approximately equal to the quick production results obtained with a standard inverted 5-spot vertical well pattern.

Many other variations and modifications may be made in the concepts described above by those skilled in the art without departing from the concept of the present invention. Accordingly, it should be clearly understood the concepts disclosed in the description are illustrative only and are not intended as limitations on the scope of the invention.

What is claimed is:

1. A method of recovering hydrocarbons from an underground formation by employing a modified inverted 5-spot well pattern, which comprises:
   - drilling four substantially horizontal wells, each horizontal well located approximately along each of the four sides of a substantially rectangular inverted 5-spot vertical well pattern;
   - said inverted 5-spot pattern containing a substantially vertical central injection well and four substantially vertical corner production wells;
   - injecting an oil recovery fluid into the formation through the central injection well;
   - producing hydrocarbons and other fluids through the vertical corner production wells;
   - ceasing production through the vertical corner wells; and
   - producing hydrocarbons and other fluids through the horizontal wells.

2. The method of claim 1, wherein the oil recovery fluid is steam, carbon dioxide, nitrogen, methane, ethane, a surfactant system, a microemulsion, a mixture or non-condensable gases, or a mixture thereof.

3. The method of claim 1, wherein production is ceased through a vertical corner well about the time recovery fluid has broken through at the vertical corner well.

4. The method of claim 1, wherein the horizontal production wells are perforated over the middle 30% to about 60% of the distance between the vertical corner wells.

5. The method of claim 1, further comprising cyclic injection and production of an oil recovery fluid at the horizontal wells prior to ceasing production at the vertical corner wells.

6. A method of recovering hydrocarbons from an underground formation by employing a modified inverted 5-spot well pattern, which comprises:
   - drilling four substantially horizontal wells, each horizontal well located approximately along each of the four sides of a substantially rectangular inverted 5-spot vertical well pattern, and each horizontal well being completed over the middle 30% to about 60% of the distance between the vertical corner wells;
   - said inverted 5-spot pattern containing a substantially vertical central injection well and four substantially vertical corner production wells;
   - injecting carbon dioxide into the formation through the central injection well;
   - producing hydrocarbons and other fluids through the vertical corner production wells;
   - ceasing production through the vertical corner wells about the time of carbon dioxide breakthrough at the corner wells; and
   - producing hydrocarbons and other fluids through the horizontal wells.

* * * * *